US006827515B2

(12) United States Patent
Harris et al.

(10) Patent No.: US 6,827,515 B2
(45) Date of Patent: Dec. 7, 2004

(54) STACKER FOR A PRINTER

(75) Inventors: Bruce Harris, Freeville, NY (US); David E. Weeks, Willseyville, NY (US)

(73) Assignee: TransAct Technologies Incorporated, Wallingford, CT (US)

( * ) Notice: Subject to any disclaimer, the term of this patent is extended or adjusted under 35 U.S.C. 154(b) by 0 days.

(21) Appl. No.: 10/379,373

(22) Filed: Mar. 4, 2003

(65) Prior Publication Data

US 2004/0175222 A1 Sep. 9, 2004

(51) Int. Cl.[7] ..... B41J 11/66
(52) U.S. Cl. ..... 400/621; 400/120.04; 400/611
(58) Field of Search ..... 400/624, 625, 400/621, 120.04, 611, 120.01; B41J 11/70

(56) References Cited

U.S. PATENT DOCUMENTS 4,660,053 A * 4/1987 Tsutsumi et al. ..... 347/215
4,761,087 A * 8/1988 Ward et al. ..... 400/621
5,041,845 A * 8/1991 Ohkubo et al. ..... 346/24
5,223,940 A * 6/1993 Matsumoto ..... 358/304
5,413,426 A * 5/1995 Ijuin et al. ..... 400/621
5,482,389 A * 1/1996 Bickoff et al. ..... 400/621
5,553,954 A * 9/1996 Nakano ..... 400/621
5,624,196 A * 4/1997 Jackson et al. ..... 400/625
5,743,663 A * 4/1998 Imai ..... 400/120.04
6,234,696 B1 5/2001 Whittaker
6,435,679 B1 8/2002 Weeks
6,652,173 B1 * 11/2003 Martini et al. ..... 400/621

* cited by examiner

*Primary Examiner*—Edward Lefkowitz
*Assistant Examiner*—Dave A. Ghatt
(74) *Attorney, Agent, or Firm*—Barry R. Lipsitz

(57) ABSTRACT

A transaction-based printer has a sheet drive for forwarding a sheet through a printing station to a cutting station where the sheet is severed from a spool by a rotary cutter. A kicker element is mounted in the cutting station. Movement of the kicker element is coordinated through the cutter drive with that of the rotary cutter so that the severed sheet is kicked into a bin located in the top cover of the printer. The printer can be, for example, an ink-jet, dot matrix, dye sublimation or thermal printer used to print tickets, vouchers, coupons or the like.

14 Claims, 4 Drawing Sheets

STACKER FOR A PRINTER

FIELD OF THE INVENTION

This invention relates to a stacker for a printer and, in particular, to a stacker for paper tickets, vouchers and the like that exit a transaction-based printer. The invention is particularly useful, e.g., in connection with gaming and lottery printers that provide racetrack tickets, lottery tickets or the like.

BACKGROUND OF THE INVENTION

High speed printers, such as inkjet, thermal, dye sublimation and dot matrix printers are used to provide vouchers, coupons, tickets, receipts and the like to consumers. For example, when a winning lottery prize becomes relatively large, the lines at ticket sales counters become long. In addition, the number of tickets purchased by each person in the line can be relatively large. Heretofore, most point of sales (POS) and other transaction-based printers have been designed to issue one ticket, voucher, coupon or receipt at a time. Sales personnel are therefore required to remove each printed sheet manually from the printer. When a number of lottery or wagering tickets, for example, are purchased in a single transaction, the sales person must compile all of the tickets for that transaction by hand. This can be a time consuming procedure leading to errors being made and long delays in ticket sales.

It would be advantageous to provide an automatic stacking function for printers used in such environments. Such a stacking function would be particularly advantageous for high speed printers that dispense quantities of tickets, vouchers, receipts, coupons and other printed substrates. Such printers are often used in wagering and lottery terminals, as well as in other point of sale terminals such as those used to print train tickets, bus tickets, movie and theater tickets, retail coupons, and other substrates of value.

The present invention provides an automated stacker for a printer having the aforementioned and other advantages.

SUMMARY OF THE INVENTION

It is a primary object of the present invention to improve transaction-based printers, such as POS printers, ticket printers, and the like. It is a further object to provide a gaming and lottery printer that will help speed the sale of tickets.

It is a still further object of the present invention to reduce the amount of manual handling required to produce a series of tickets, vouchers, coupons or other printed substrates purchased under one sale transaction.

Another object of the present invention is to provide an automatic stacker for a small transaction-based printer that does not increase the size of the printer.

These and other objects of the present invention are attained by a transaction-based printer that has a first drive for advancing a sheet through the printer in a first direction. A kicker element is adapted to contact the sheet after printing. A second drive is operatively associated with the kicker element for advancing the sheet in a second direction opposite the first direction. An output bin is provided for collecting the sheet when it is advanced in the second direction.

In another embodiment, a sheet drive is provided for advancing sheet material from a spool through a printing station and then registering the sheet in a stationary condition within a cutting station. A cutter, such as a rotary cutter, is mounted within the cutting station. The cutter can include, for example, a stationary blade and a movable blade for severing the registered sheet from the spool. A kicker element (e.g., a kicker wheel) is mounted upon a shaft within the cutting station. A clutch allows the kicker element to freely rotate in one direction as the sheet is forwarded into the cutting station. A drive system that is associated with the cutter control mechanism reverses the direction of rotation of the kicker element once the cutting operation is completed, locking the clutch and thus causing the severed sheet to be kicked into a collecting bin.

BRIEF DESCRIPTION OF THE DRAWINGS

For a further understanding of the present invention, reference will be made to the following detailed description of the invention which is to be read in association with the accompanying drawings, wherein.

DETAILED DESCRIPTION OF THE INVENTION

Figure 1:
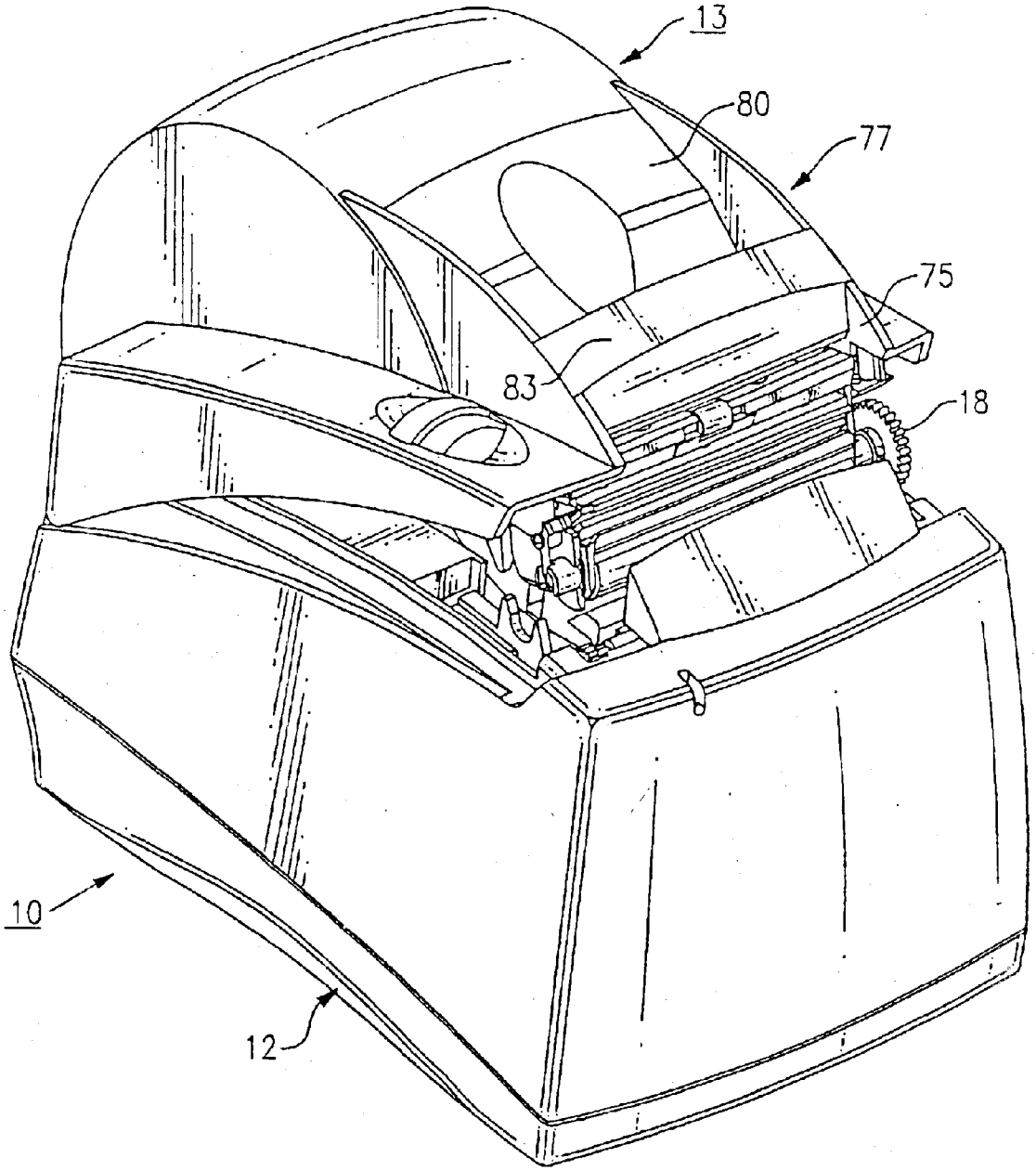
FIG. 1 is a perspective view of a point of sale printer showing the printer cover slightly raised.

Turning now to the drawings, there is illustrated a printer, generally referenced 10, that embodies the teachings of the present invention. It is noted that the illustrated printer is only one example embodiment of a printer that can incorporate the features of the present invention.

The printer 10 includes a rectangular shaped housing 12 upon which a hinged cover 13 is provided. The hinge is located at the back of the housing cover so that the cover can swing upwardly and rearwardly to provide ready access to a paper bin located in the rear of the printer housing. The bin is configured to accept a supply spool of paper 15, which serves as the substrate for printing a ticket, voucher, coupon or the like. A main feed roller 17 is rotatably mounted in the cover and contains a gear 18 that is affixed to one end of feed roller shaft 19. The feed roller gear 18 is arranged to mesh with an intermediate or idler gear 20 when the cover is closed. The idler gear 20 forms part of the main drive system of the printer and is coupled to the main drive gear 23 by means of a second idler gear 24. The drive gear 23 is mounted upon the output shaft 25 of a drive motor that is housed within the control section 27 of the printer.

Figure 5:
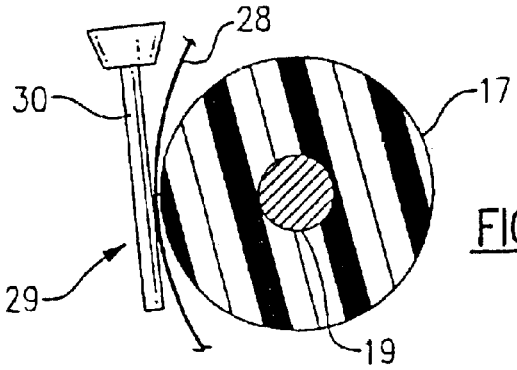
FIG. 5 is a partial sectional view taken through the drive roller of the sheet feed drive.

The present printer as herein described is a thermal printer, however, as should become apparent from the disclosure below, the present invention is applicable for use in any type of gaming, lottery, POS, or other transaction-based printer that is known and used in the art. For a thermal printer implementation, the paper on the supply spool is fabricated of a heat sensitive (i.e., thermal) material. The end of the spool first is threaded through a printing station 29 as illustrated in FIG. 5 and is held tightly against a thermal printing head 30 by the feed roller 17 when the cover is moved to a closed position. Sufficient friction is provided between the printing head and the feed roller to advance the paper through the printing station, where a desired image is applied to the paper based on an input from the printer control section 27 using well known thermal printing techniques.

Figure 4:
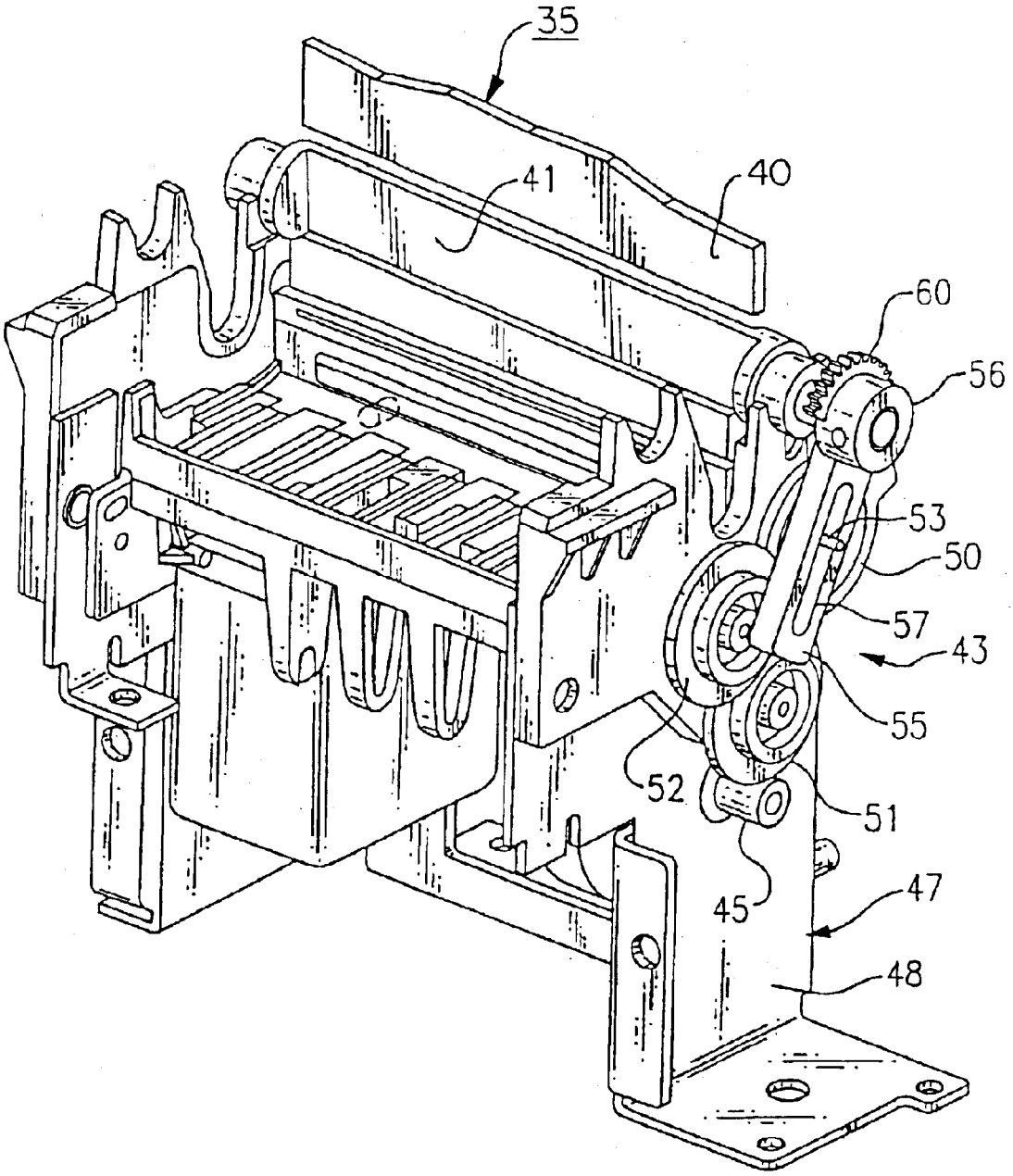
FIG. 4 is a partial perspective view of the printer main frame with parts broken away to better illustrate the cutting station of the printer.

The imaged substrate is advanced by the feed roller into the cutting station 35 (FIG. 4) where the paper is registered and the feed roll drive is deactivated as the printed ticket, voucher, coupon or the like is severed from the supply spool. A rotary cutter is located in the cutting station. The cutter includes a stationary upper blade 40 and a coacting rotatable lower blade 41 (FIG. 4). The paper is guided into the cutting station between the two blades and as will be described in greater detail below, and is cut from the spool by rotating the movable blade past the fixed blade. It should be appreciated that the particular type of cutter is not critical, and other types of cutters can be substituted for the rotary cutter described herein. Alternatively, precut paper stock can be used, in which case no cutter is required in the printer.

Figure 2:
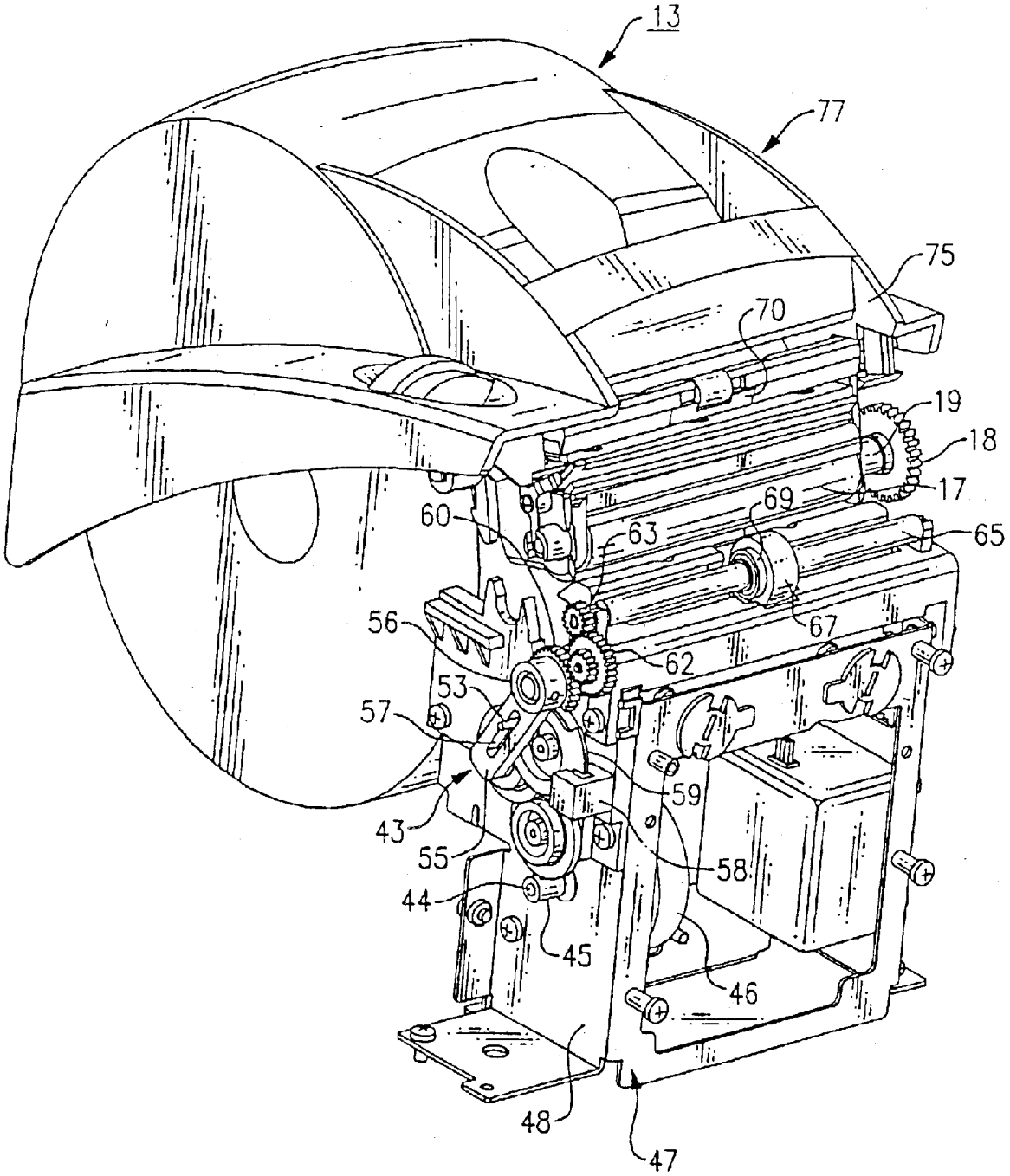
FIG. 2 is a left perspective view of the printer shown in FIG. 1 with the bottom part of the printer housing being removed to further show the cutter and kicker element drive system.
Figure 3:
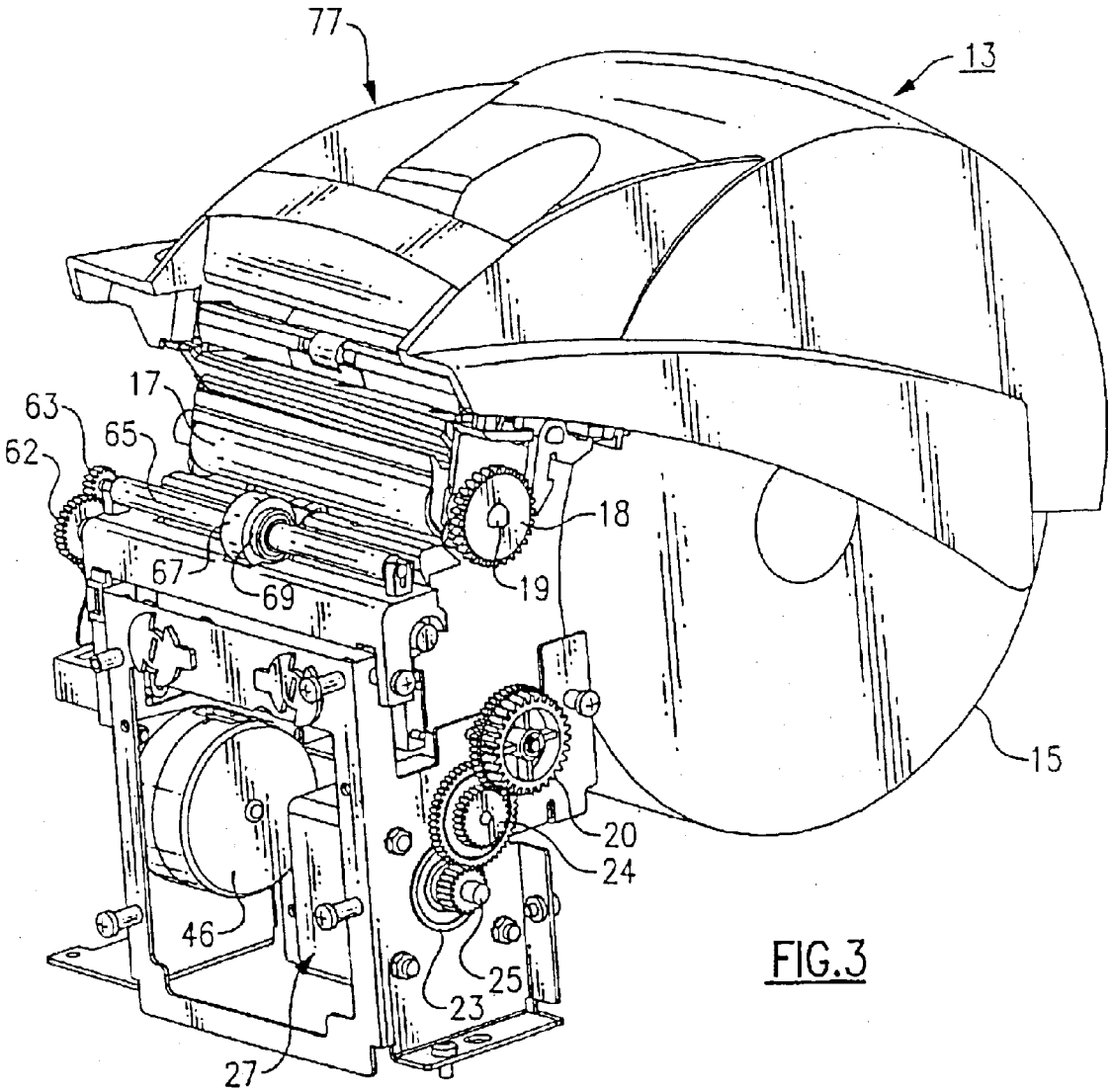
FIG. 3 is a right perspective view of the printer similar to that shown in FIG. 2 further showing the sheet feed drive system.

The operation of the cutter in the illustrated embodiment is independently controlled through a separate cutter drive system best illustrated in FIG. 2 and generally referenced 43. The cutter drive system includes its own cutter drive motor 46 mounted upon the main frame 47 of the printer. The shaft 44 of the cutter drive motor passes through the side wall 48 of the frame and has a drive pinion 45 secured thereto. The drive pinion is coupled to a drive wheel 50 (FIG. 4) by a pair of idler gears 51 and 52 that are arranged to turn the drive wheel at a desired speed. A pin 53 is mounted upon the outer face of the wheel and protrudes outwardly from the wheel face.

As illustrated in FIGS. 2 and 4, a rocker arm 55 is secured to one end of the rotatable cutter blade 41 by means of a mounting hub 56. The arm contains an elongated slot 57 in which the drive wheel pin rides. An optical sensor 58 is mounted within a housing adjacent to the drive wheel. A tab or flag 59 is carried by the drive wheel and is adapted to pass through a slit in the sensor housing to generate an output signal to the controller indicating when the rotatable blade has reached the end of cut position. At this time, the direction of rotation of the cutter motor is reversed and the rotatable cutter blade is returned to the home or start of cut position.

A gear segment 60 is carried upon the mounting hub of the rocker arm. The gear segment mates with an idler gear 62 which in turn mates with a drive gear 63 affixed to one end of a kicker roll shaft 65 that is journaled for rotation in the upper part of the printer main frame 47. A kicker roll 67 is carried upon the kicker roll shaft and is coupled to the shaft by a one way clutch 69. Paper that is forwarded into the cutting station will pass through a nip created between the kicker roll and a backing plate 70 that is carried by the cover. The nip is formed when the cover is brought to a fully closed position. The clutch is arranged to permit the kicker roll to rotate freely upon the kicker roll shaft when the paper is forwarded from the printing station into the cutting station and as the movable blade is moved from its home position to the end of cut position.

Upon the return stroke of the rotatable cutter blade, the rotation of the kicker roll shaft is reversed and the clutch now locks the kicker wheel to the shaft. Accordingly, the severed paper ticket, voucher, coupon or the like (the "cut sheet") is driven by the kicker wheel through the discharge opening 75 in the cover back toward a collecting bin 77 located in the top of the cover. A sheet guide is positioned at the entrance to the bin that directs the cut sheet into the bin. The bottom wall 80 of the bin (FIG. 1) is inclined downwardly and serves to direct the sheets entering the bin downwardly so that the lower portion of each sheet is captured under the top half wall 83 of the bin.

While the present invention has been particularly shown and described with reference to the preferred mode as illustrated in the drawing, it will be understood by those skilled in the art that various changes in detail may be effected therein without departing from the spirit and scope of the invention as defined by the claims.

We claim:

1. Apparatus for automatically stacking printed sheets from a printer comprising:

a first drive for advancing a sheet through said printer in a first direction, said first drive including a sheet drive roller adapted to advance said sheet through a printing station and register the sheet within a cutting station;

a kicker element adapted to contact said sheet after printing;

a second drive operatively associated with said kicker element for advancing said sheet in a second direction opposite said first direction, said second drive being configured to actuate a cutter for the sheet within said cutting station before advancing the sheet in the second direction; and an output bin for collecting said sheet when the sheet is advanced in said second direction.

2. The apparatus of claim 1 wherein said first and second drives each have a separate drive motor.

3. The apparatus of claim 2 further comprising a controller adapted to control the operation of the motors for the first and second drives.

4. The apparatus of claim 1 wherein said kicker element is operatively associated with said cutter.

5. The apparatus of claim 1 further comprising a housing having a top cover pivotally mounted thereon, wherein said output bin is pivoted in said cover.

6. The apparatus of claim 1 wherein said printer is one of an ink-jet, dot matrix, dye sublimation and thermal printer.

7. The apparatus of claim 1 wherein:

said first drive advances said sheet from a spool toward a cutting station;

a rotary cutter is provided in the cutting station for severing said sheet from the spool;

said second drive moves said rotary cutter from an open start of cut position to an end of cut position and from said end of cut position back to a start of cut position; and said kicker element advances the sheet in said second direction, after the sheet is severed at the cutting station, when the rotary cutter moves from said end of cut position back to start of cut position.

8. The apparatus of claim 7 wherein:

said kicker element comprises a wheel mounted on a shaft; and a clutch is operatively associated with said wheel so that the wheel turns freely when the rotary cutter is moved from the start of cut position to the end of cut position and the wheel is locked to the shaft when the rotary cutter is moved from said end of cut position back to the start of cut position.

9. The apparatus of claim 8 wherein said wheel advances said sheet in said second direction when the wheel is locked to said shaft.

10. The apparatus of claim 7 further comprising a sensor for detecting when said rotary cutter reaches said end of cut position; and said second drive is responsive to said sensor for reversing direction.

11. Apparatus for automatically stacking printed sheets from a printer comprising:

a first drive for advancing a sheet through said printer in a first direction from a spool toward a rotary cutter adapted to sever said sheet from the spool;

a kicker element adapted to contact said sheet after printing;

a second drive operatively associated with said kicker element for advancing said sheet in a second direction opposite said first direction and for moving said rotary cutter from an open start of cut position to an end of cut position and from said end of cut position back to said start of cut position;

said kicker element being adapted to advance the sheet in said second direction, after the sheet is severed at the cutting station, when the rotary cutter moves from an end of cut position back to said start of cut position; and an output bin for collecting said sheet when the sheet is advanced in said second direction.

12. The apparatus of claim 11 wherein:

said kicker element comprises a wheel mounted on a shaft; and a clutch is operatively associated with said wheel so that the wheel turns freely when the rotary cutter is moved from the start of cut position to the end of cut position and the wheel is locked to the shaft when the rotary cutter is moved from said end of cut position back to the start of cut position.

13. The apparatus of claim 12 wherein said wheel advances said sheet in said second direction when the wheel is locked to said shaft.

14. The apparatus of claim 11 further comprising a sensor for detecting when said rotary cutter reaches said end of cut position; and said second drive is responsive to said sensor for reversing direction.

* * * * *